US006318880B1

(12) United States Patent
Siminovitch et al.

(10) Patent No.: US 6,318,880 B1
(45) Date of Patent: Nov. 20, 2001

(54) PORTABLE LAMP WITH DYNAMICALLY CONTROLLED LIGHTING DISTRIBUTION

(75) Inventors: Michael J. Siminovitch, Pinole; Erik R. Page, Berkeley, both of CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 09/525,610

(22) Filed: Mar. 14, 2000

(51) Int. Cl.[7] ..... F21V 7/05; F21Y 103/02; F21S 8/08

(52) U.S. Cl. ..... 362/225; 362/216; 362/247; 362/251; 362/295; 362/411

(58) Field of Search ..... 362/216, 225, 362/241, 247, 251, 260, 295, 394, 395, 411, 33, 801

(56) References Cited

U.S. PATENT DOCUMENTS 1,686,571 * 10/1928 Plaut ..... 362/247
2,215,531 * 9/1940 Pieper ..... 362/33
2,350,462 * 6/1944 Johns ..... 362/216
2,475,237 * 7/1949 Gordon ..... 362/395
3,059,137 * 10/1962 Reaves ..... 362/260
3,201,582 * 8/1965 Siegel ..... 362/295
3,742,208 * 6/1973 Mills ..... 362/216
4,225,905 * 9/1980 Moriyama et al. ..... 362/216
4,300,185 * 11/1981 Wakamatsu ..... 362/33
4,816,969 * 3/1989 Miller ..... 362/394
5,931,556 * 8/1999 Herst et al. ..... 362/33
5,961,204 * 10/1999 Martich et al. ..... 362/295

* cited by examiner

*Primary Examiner*—Alan Cariaso
(74) *Attorney, Agent, or Firm*—Henry P. Sartorio

(57) ABSTRACT

A double lamp table or floor lamp lighting system has a pair of compact fluorescent lamps (CFLs) arranged vertically with a reflective septum in between. By selectively turning on one or both of the CFLs, down lighting, up lighting, or both up and down lighting is produced. The control system can also vary the light intensity from each CFL. The reflective septum insures that almost all the light produced by each lamp will be directed into the desired light distribution pattern which is selected and easily changed by the user. Planar compact fluorescent lamps, e.g. circular CFLs, particularly oriented horizontally, are preferable. CFLs provide energy efficiency. The lighting system may be designed for the home, hospitality, office or other environments.

18 Claims, 4 Drawing Sheets

PORTABLE LAMP WITH DYNAMICALLY CONTROLLED LIGHTING DISTRIBUTION

GOVERNMENT RIGHTS

The United States Government has the rights in this invention pursuant to Contract No.DE-AC03-76SF00098 between the United States Department of Energy and the University of California.

BACKGROUND OF THE INVENTION

The invention relates generally to interior lighting for residences, businesses and other locations, and, in particular, to fluorescent lighting.

The 1990's have seen a renewed national commitment to saving energy. However, in many areas residential lighting energy conservation efforts have not generally delivered their full potential. While most end use areas have seen 30 to 50 percent efficiency improvements, numerous resources remain unmined. Moreover, lighting efficiency has been, in places, clumsily implemented and consequently, has not been well received by consumers. Residential lighting in particular, is a microcosm of these larger trends.

Each year in the U.S. about 145 billion kilowatt-hours of energy are used to light homes, at a cost of 10 billion dollars, and resulting in the emission of approximately 140 million tons of carbon dioxide. Promoting and installing more efficient residential light sources, fixtures, and controls can significantly reduce these numbers. The compact fluorescent lamp (CFL) is the most dramatic example of such a technology, offering a 75 percent increase in total lamp lumens per watt over the ubiquitous general service incandescent lamp (A-lamp). Unfortunately, actual applications of CFLs often fail to deliver on promises of equivalent light quality, quantity, and distribution, at comparable cost to traditional lighting.

One of the most popular residential lighting fixtures is the table lamp fixture. These use almost exclusively 60–100 watt incandescent lamps. But they do not offer distribution control.

The current perceptions of CFL table lamps are that they are expensive, not bright enough, prone to failure, and don't look good. This results in widespread consumer rejection. Thus, of the large potential market for residential table lamps, 90 million homes with three plus table lamps per home, CFLs have attained only about 1 percent market share or less.

Of all CFL table lamps, most are screw-based retrofits (Edison sockets); almost none are pin-based hardwired fixtures. Most common are lamps with single, vertically oriented CFLs, e.g. 9–40 watt twin, quad and multi-tube configurations. Some of these are encapsulated in a plastic capsule or globe. The vertical orientation is inefficient in that it directs flux towards the shade. Single lamps offer no control of light distribution out of the fixture. Single planar CFL lamps, e.g. circline and 2D CFLs, are better inside shaded table lamp fixtures, but control is only available through level/intensity control with electronic ballasts.

There is a commercial hardwired table lamp configuration using three twin-tube CFLs arranged radially in a vertical orientation. Switching one, two, and three lamps offers three level intensity control, but there is no control over light distribution.

Multi-lamp incandescent table and floor lamps have traditionally offered level intensity control, typically in dual or triple lamp configurations, usually arranged radially around the center, or with three level switching and/or dimming of a single lamp, e.g. a 50–100–150 W A-lamp. However, control over distribution of light out of the fixture into the room has not generally been provided.

A significant feature of a new lighting fixture based on any type of lamp would be control of light distribution out of the lamp, i.e. the user can readily select and vary the light distribution to meet changing needs. For example, under some conditions direct lighting is needed, while under other conditions indirect lighting is desired. Thus a light fixture which allows a user to readily switch between direct lighting, indirect lighting, or both, would be highly advantageous since the lamp would deliver most of the light where it is needed. Coupled with efficient light sources, e.g. CFLs, tremendous lighting efficiency can be achieved. Unfortunately, present lamps are generally configured with a fixed light output distribution pattern which cannot be changed by the user.

Therefore, it is desirable to provide new lamp fixture configurations for CFL based lamps which take advantage of the great advances in CFL technology made in recent years and which allow easy selection and control of light distribution. High quality phosphors and electronic ballasts produced in the 1990's and the many new shapes, sizes, and colors available provide a lot of flexibility in lighting options. However, the integration of CFLs into table lamps has primarily involved trying to make CFLs behave like incandescent lamps instead of taking advantage of the inherent characteristics of the CFLs. The new design should have high performance, flexibility in control, and provide lots of light for user amenities. A new CFL table lamp fixture design with these features could capture a significant market share. At present, with 90 million homes having three plus table lamps per home at a cost of about $75.00 plus per fixture, with a present CFL market share of less than one percent, there is huge potential for market growth with an efficient CFL fixture. The market potential is further expanded when the lighting system design is applied to table lamps for offices, hotels and other locations, and floor lamps for all these locations.

SUMMARY OF THE INVENTION

Accordingly, it is an object of the invention to provide an improved lighting fixture design for CFL based table and floor lamps, for broad residential, hospitality, and commercial lighting applications.

It is also an object of the invention to provide a lighting fixture geometry for table and floor lamps based on CFLs, that produces controlled light distribution, controlled light intensity, lots of light, and other user amenities.

The invention is a lighting fixture, and a complete table or floor lamp including the fixture, in which two lamps are mounted in a spaced apart vertical relation with a reflective septum between the two lamps. Additional lamps may also be added above and/or below the septum so that there is at least one lamp above the septum and at least one lamp below the septum. The two lamps are compact fluorescent lamps (CFLs), and preferably are planar CFLs. The lamps are preferably mounted in a substantially horizontal orientation. The lamps are preferably circular in geometry, but other geometries can also be used. The lamps and separating reflective septum are also surrounded by a lateral shade which is open at the top and bottom. A user control switch and dimmer allows the user to control lamp output light distribution in three modes: down light only, up light only, or a combination of down light and up light. The control switch also allows user control of light level in each of the lamps. The reflective septum maintains the up/down or combination distribution and also controls stray light and increases efficiency. Thus, the lamp produces a lot of light in a selectable or easily controllable distribution. The optical relationship (geometry) between the lamps, reflective septum, and shade can be designed to maintain even shade luminance while maximizing fixture efficiency and control. Color control may also be achieved by using different color temperature lamps. For example, users may want to have predominantly high color temperature lighting directed upwards (for indirect lighting) and low color temperature lighting directed downwards (for direct lighting). The dual CFL fixture may be used in both table lamps and floor lamps.

DETAILED DESCRIPTION OF THE INVENTION

As used herein and as commonly used in the industry, the term "lamp" refers to both the light producing element, e.g. a fluorescent lamp (a fluorescent tube or a CFL) or an incandescent lamp (a light bulb), and to the entire lighting apparatus or luminaire, e.g. a table lamp or floor lamp. The meaning will generally be apparent from the context. The term "fixture" generally refers to the parts of the lighting apparatus other than the light producing element, and is often sold separately from the light producing elements. The fixture thus normally includes the mechanical support structure, the socket, the control switch, and the shade.

The invention is directed to "table lamps" which are generally all portable lamps which are placed on tables, desks, or other work surfaces. The invention is also directed to "floor lamps" which are generally portable lamps which stand on a floor.

Figure 1A:
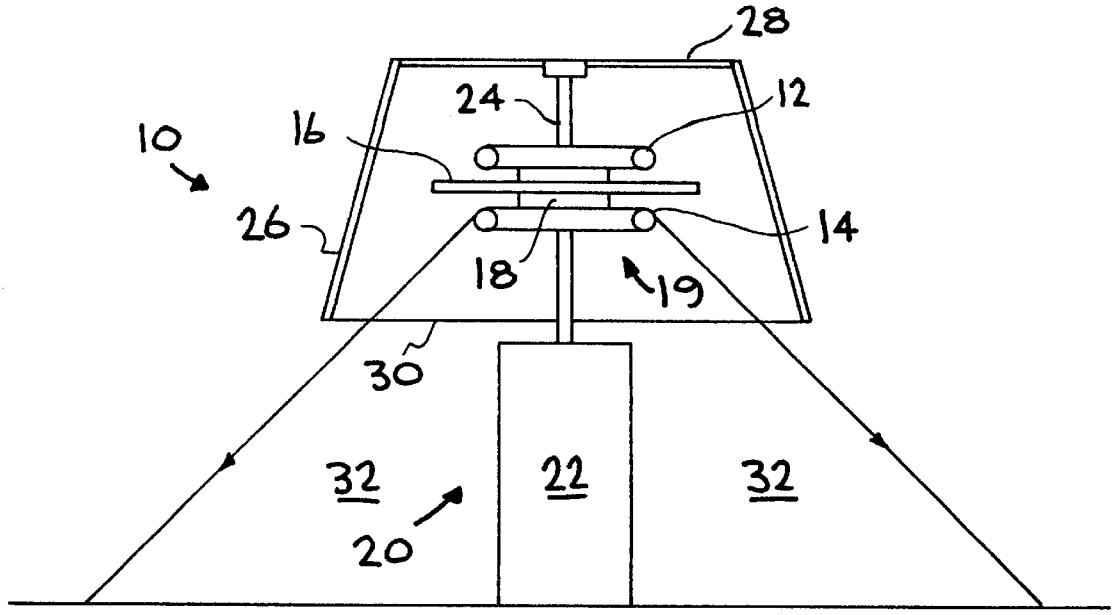
FIGS. 1A–C are side views of a table lamp with the double lamp geometry of the invention, with down light distribution, up light distribution, and up/down light distribution respectively.
Figure 1B:
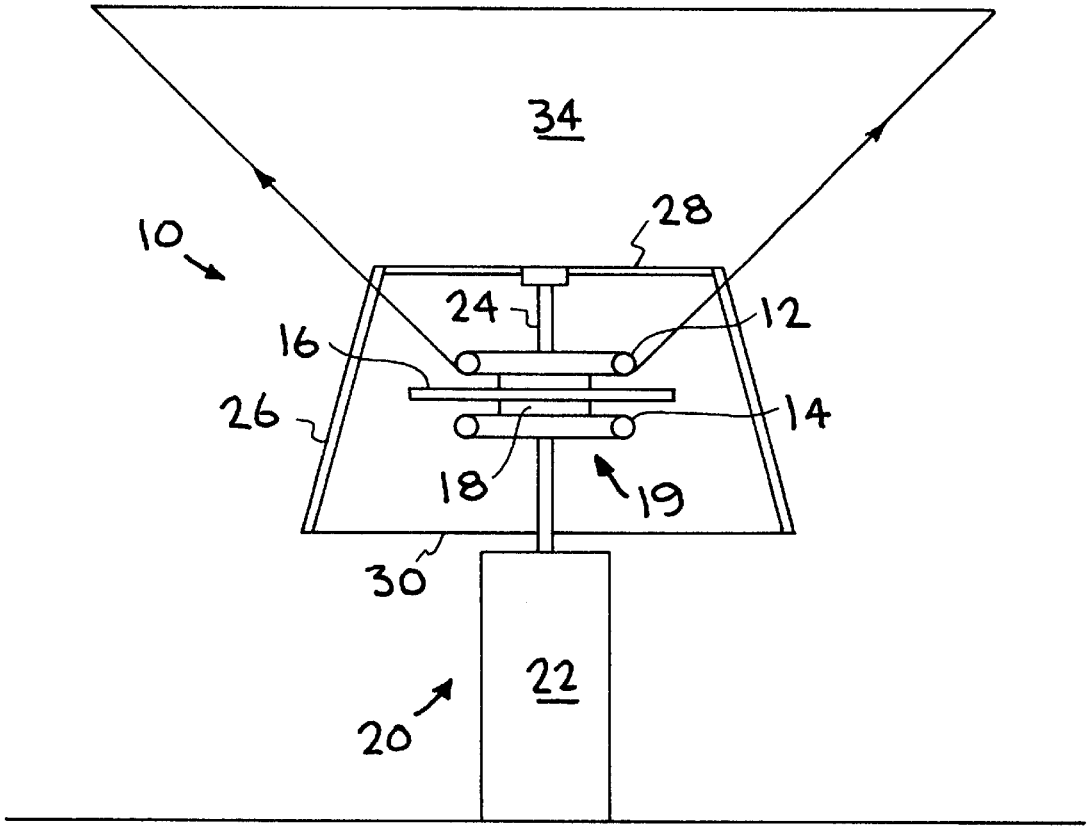
Figure 1C:
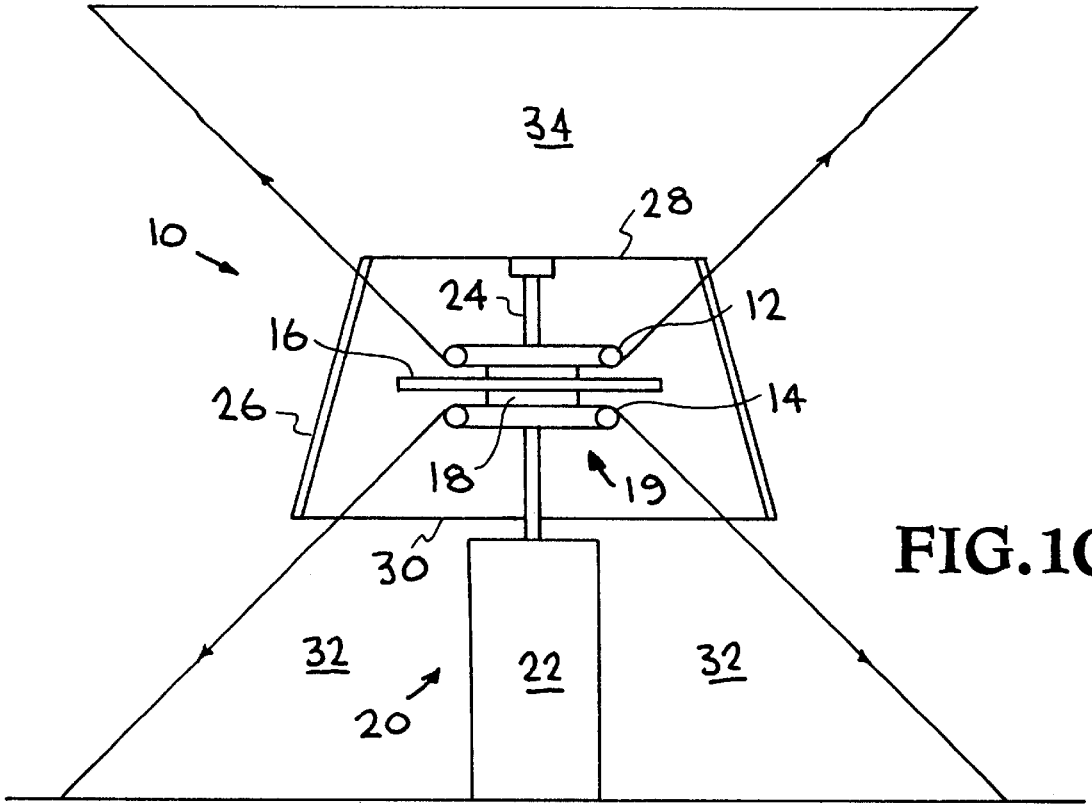

A table lamp or lighting apparatus 10, as illustrated in FIGS. 1A–C, has a pair of planar compact fluorescent lamps (CFLs) 12, 14 arranged substantially horizontally in a spaced apart vertical relationship in a fixture 20. A reflective septum 16 is positioned between the two planar compact fluorescent lamps 12, 14 and is reflective on both its top and bottom surfaces. The planar fluorescent lamps 12, 14 are also plugged into a socket 18. The planar fluorescent lamp-reflective septum-electrical socket assembly 19 is mounted on the vertical member 24 of light fixture 20. Vertical element 24 extends from base or pedestal portion 22 of fixture 20. The two fluorescent lamps 12, 14 and reflective septum 16 are surrounded by a round conical shade 26 which is open at its top surface 28 and bottom surface 30. Fixture 20 includes the mechanical support structure formed by base 22 and vertical member 24, as well as reflector 16, socket 18, shade 26, and a light switch (not shown), i.e. everything but lamps 12, 14.

As shown in FIG. 1A, the bottom CFL 14 is turned on, producing a down light distribution represented by light cone 32. As shown in FIG. 1B, the top CFL 12 is illuminated, producing an up light distribution represented by light cone 34. As shown in FIG. 1C, both CFLs 12, 14 are lit, producing an up-down light distribution represented by the pair of light cones 32, 34. Thus the user can control the lighting distribution from the lamp.

Because the fluorescent lamps 12, 14 are planar and horizontally oriented, little of the light is emitted laterally. Most of the light will be emitted vertically. The reflective septum 16 directs all light outwards (i.e. either upwards, downwards, or both) from the lamp. Thus, the configuration is highly efficient in providing most of the light produced by the lamp to the user. Since the lamps 12, 14 are CFLs, they are highly energy efficient in producing the light.

Figure 2A:
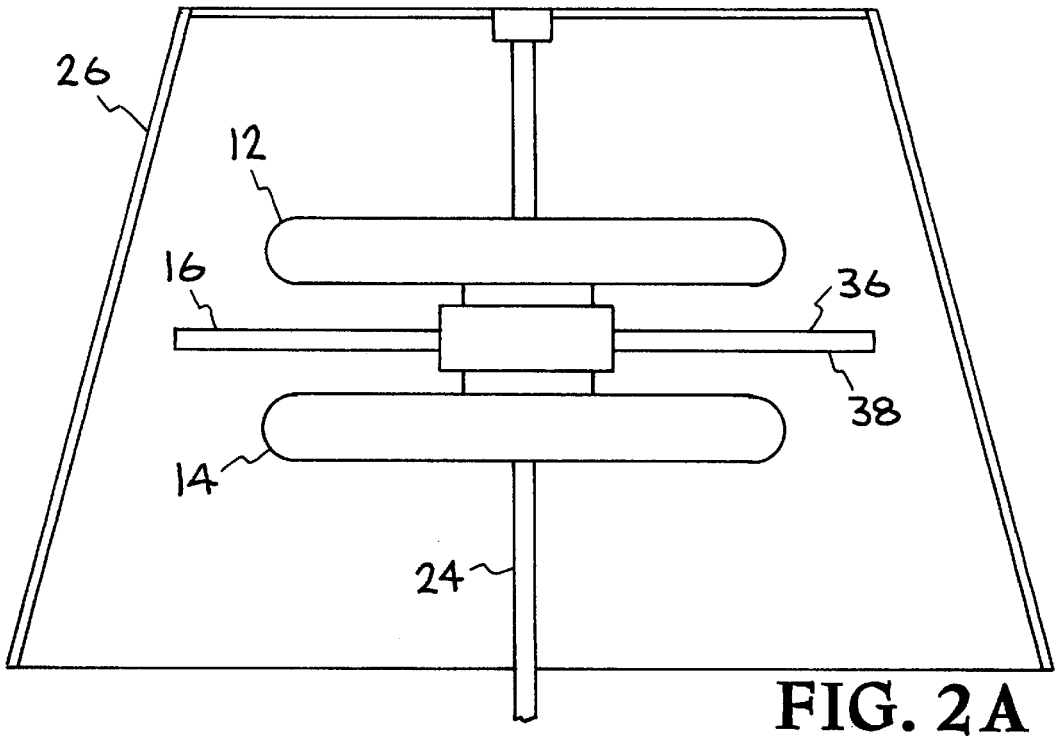
FIG. 2A is a side sectional view showing the details of the two planar lamps, lamp socket, reflective septum, and shade.

FIG. 2A shows greater detail of the two planar fluorescent lamps 12, 14, reflective septum 16 and socket 18. The planar fluorescent lamps 12, 14 are preferably circular, e.g., circline CFLs, since they produce the most uniform 360 degree distribution of light. However, other planar non-circular CFLs, e.g. 2D CFLs, can also be used. The two lamps 12, 14 are plugged into socket 18 which is preferably a pin type socket positioned between lamps 12, 14 but may also be a screw type socket. Socket 18 may be a multiple lamp socket or may instead be a plurality of individual sockets. Reflective septum 16 extends out from socket(s) 18 at least to and generally beyond the lateral extent of the planar fluorescent lamps 12, 14. Reflective septum 16 is reflective on both its upper surface 36 and lower surface 38 so that any light emitted by lamps 12, 14 which is initially directed toward septum 16 will be reflected back away from septum 16 and out of the lamp. The pair of horizontal lamps 12, 14 are surrounded by a V-shaped annular shade 40 in place of the conical shade 26 of FIGS. 1A–C. Different shapes and styles of the lampshade 26 or 40 may be used for providing different aesthetic looks and improved performance by directing light out of the fixture. Similarly, different styles of the fixture 20 (particularly the base portion 22) may be used for aesthetic reasons. Also, the shade 40 may have a reflective inner surface so that the small amount of light from the lamps 12, 14 incident thereon will also be reflected out of the lamp.

Figure 2B:
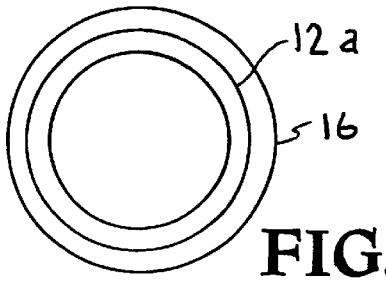
FIGS. 2B–D are top views of circular, multitube, and single tube planar lamps over a reflective septum.
Figure 2C:
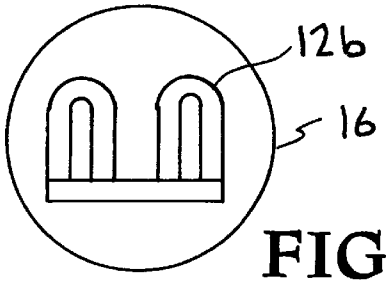
Figure 2D:
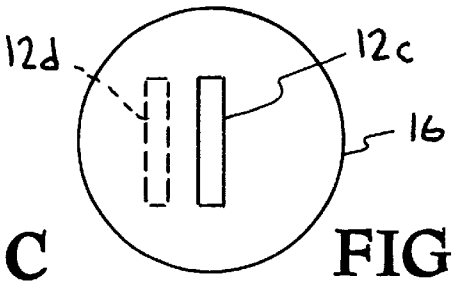

FIGS. 2B–D are top views of a planar fluorescent lamp 12 positioned above a reflective septum 16 wherein lamp 12 is a circular lamp 12*a*, a multitube lamp 12*b* and a single tube lamp 12*c* respectively. In general, CFLs 12, 14 may have any configuration, including nonplanar, and any orientation, including vertical. However, substantially planar horizontally oriented lamps are preferred so that most of the light is directed up or down. Additional lamps, e.g. optional lamp 12*d* in FIG. 2D, may also be added above and/or below the septum 16, so that there is at least one lamp above the septum and at least one lamp below the septum.

Figure 3:
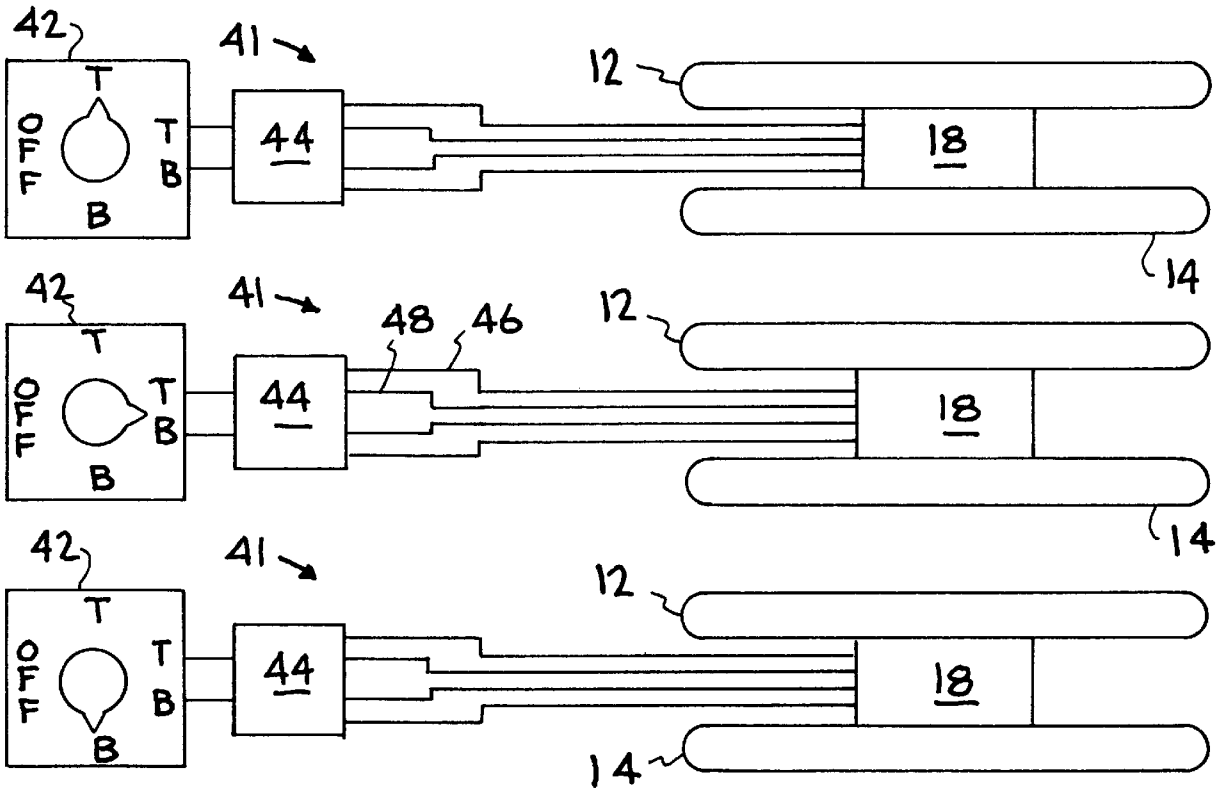
FIG. 3 shows the control system for the double lamp configuration.

The user control is a switching/dimming (lighting control) system 41 as shown in FIG. 3. A control switch/dimmer (controller) 42 is electrically connected to ballast 44 which is connected through electrical wires 46, 48 to electrical socket(s) 18 to which fluorescent lamps 12, 14 are connected. In its simplest form, controller 42 is a three-way on-off switch, which has three positions to control light distribution from the lamp. In position 1, the top lamp 12 is on and the bottom lamp 14 is off, producing up lighting. In position 2, the top lamp 12 and bottom lamp l4 are both on, producing up/down lighting. In position 3, the top lamp 12 is off and bottom lamp 14 is on, producing down lighting. In a more complex form, controller 42 includes a dimmer which can also adjust the voltage to each of the lamps 12, 14 to control light intensity (light level control) from the lamps as well as distribution pattern. Lamps 12, 14 can also be selected to produce different color outputs, e.g. upper lamp 12 can produce high color temperature light while lower lamp 14 can produce lower color temperature light. Thus a simple controller allows the user to readily select a light distribution pattern which is optimum for particular conditions, i.e. up lighting, down lighting or both, and to also vary the intensity of the light in either or both of the up lighting or down lighting. Different color light can also be provided in the up and down directions.

Figure 4:
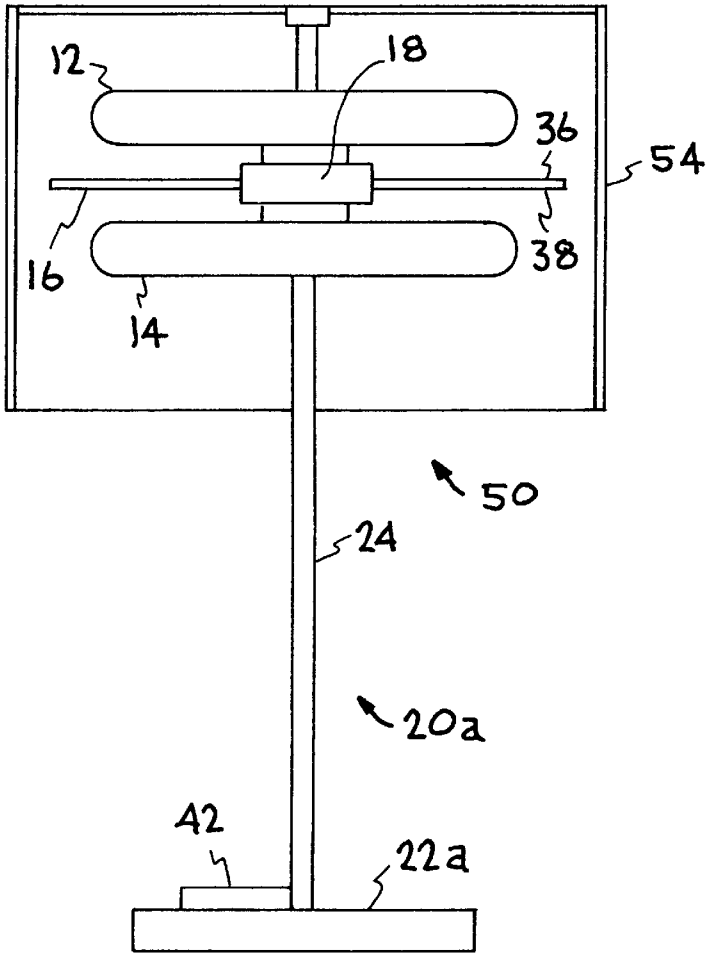
FIG. 4 is a side view of an alternate embodiment of a table lamp of the invention.

FIG. 4 shows an alternate embodiment of a table lamp of the invention presenting a different aesthetic appearance from the lamp of FIG. 1A–C. Lamp 50 has a fixture 20*a* which has a flat base 22*a* and a vertical member 24 extending up from base 22*a*. The lighting controller 42 is mounted on base 22*a* with the wires (not shown) extending up through vertical member to 24 the lamp's socket(s) 18. A cylindrical shade 54 is used in place of conical lampshade 26 of FIGS. 1A–C or the V-shaped annular shade 40 of FIG. 2A. The dual planar lamps 12, 14 with the reflective septum 16 in between are similar to the prior embodiments.

The fixtures 20, 20*a* are functionally the same but have different ornamental appearances. The bases 22, 22*a* and vertical member 24 can take a number of different aesthetic configurations. The lampshades can take a wide variety of ornamental (and sometimes functional) configurations. Shades 26, 40, 54 illustrate three styles; however, any lateral light blocking element can be used.

Because the lamps are planar and oriented horizontally, most of the emitted light will be directed up or down and not laterally. The shade will block the lateral light. The shade may be opaque or it may be translucent. If it is translucent, the lamp can be designed to make the shade more or less uniformly luminous. For example, reflector 16 should have a diameter at least as great as the diameter of CFLs 12, 14 so that light from one cannot directly enter the distribution pattern of light from the other. However, if reflector 16 extends all the way to the shade, then no light from the top or bottom lamp can reach the opposite part of the shade and only a part of the shade will be luminous when only one of the lamps is lit. To avoid this effect, a sufficient gap may be left between the reflector 16 and the shade so that the shade will be illuminated by either CFL without seriously affecting the light distribution output of the lamp.

The lamps may be designed specifically for home lighting applications or may be designed for office lighting conditions or other environments, e.g. hotels and motels, schools, or libraries. Aesthetic appearance can be tailored to specific environments.

Figure 5:
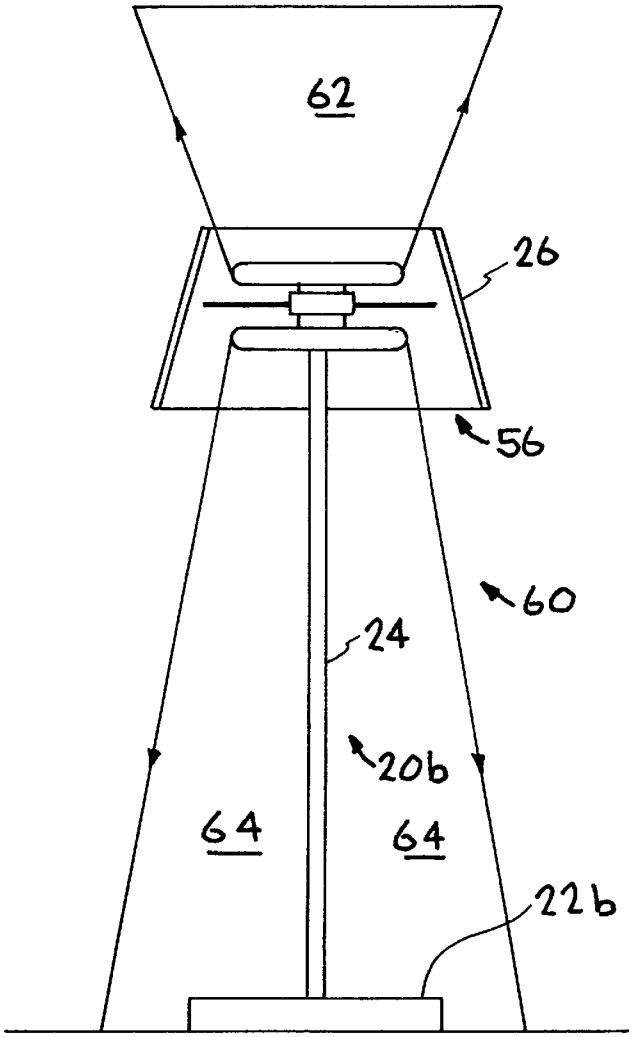
FIG. 5 is a side view of a floor lamp according to the invention.

As shown in FIG. 5, a floor lamp 60 according to the invention has a fixture 20*b* with a flat base 22*b* and a vertical member 24. The dual planar lamp-reflector-socket assembly 56 is mounted at the top of vertical member 24 and surrounded by an annular shade 54. Lamp 60 provides a selectable combination of indirect lighting, represented by up light cone 62, and direct lighting, as represented by down light cone 64, or both.

As shown, floor lamp 60 looks a lot like table lamp 50 of FIG. 4, except for the relative proportions, since vertical member 24 will be much taller in lamp 60 than in lamp 50. However, floor lamp 60 may have other aesthetic appearances. In particular, base 22*b*, vertical member 24, and shade 54 may have other ornamental and structural designs.

Changes and modifications in the specifically described embodiments can be carried out without departing from the scope of the invention which is intended to be limited only by the scope of the appended claims.

What is claimed is:

1. A lighting fixture for a table or floor lamp comprising:

a table or floor lamp support structure;

a reflective septum mounted to the support structure in a substantially horizontal orientation, the septum being reflective on both its top and bottom surfaces;

at least one electrical socket mounted on the support structure;

a lighting control system connected to the at least one electrical socket;

a lateral shade mounted on the support structure around the reflective septum;

wherein the fixture is configured to mount at least a pair of compact fluorescent lamps (CFLs) in the fixture with at least one lamp above the reflective septum and at least another lamp below the reflective septum.

2. The lighting fixture of claim 1 wherein the support structure is configured to mount the CFLs in the fixture in a substantially horizontal orientation.

3. The lighting fixture of claim 1 wherein the lighting control system comprises an on-off switch for selectively turning on and off each of the CFLs to be mounted in the fixture to selectively produce down light, up light, and both up and down light distribution.

4. The lighting fixture of claim 3 wherein the lighting control system further comprises a dimmer for selectively controlling the light intensity of each CFL.

5. The lighting fixture of claim 1 wherein the lighting control system further comprises a ballast for the CFLs.

6. A table or floor lamp comprising:

the lighting fixture of claim 1;

at least a pair of CFLs mounted in the fixture.

7. The table or floor lamp of claim 6 wherein each CFL is a planar CFL.

8. The table or floor lamp of claim 7 wherein each planar CFL is a circular planar CFL.

9. The table or floor lamp of claim 6 wherein the lighting control system comprises at least an on-off switch for selectively turning on and off each of the CFLs to selectively produce down light, up light, and both up and down light distribution, and optionally comprises a dimmer for selectively controlling the light intensity of each CFL.

10. A table or floor lamp lighting apparatus comprising:

a table or floor lamp lighting fixture having a horizontal reflective septum;

a pair of compact fluorescent lamps (CFLs) mounted in the fixture with one lamp above the reflective septum and the other below the reflective septum.

11. The apparatus of claim 10 wherein the lighting fixture further comprises a lighting control system for operating the pair of lamps.

12. The apparatus of claim 11 wherein the lighting control system comprises an on-off switch for selectively turning on and off each of the lamps to selectively produce down light, up light, and both up and down light distribution.

13. The apparatus of claim 12 wherein the lighting control system further comprises a dimmer for selectively controlling the light intensity of each lamp.

14. The apparatus of claim 11 wherein the lighting control system further comprises a ballast for the compact fluorescent lamps.

15. The apparatus of claim 10 wherein each lamp is a planar lamp.

16. The apparatus of claim 15 wherein each lamp is a circular planar lamp.

17. The apparatus of claim 10 further comprising one or more additional CFLs mounted either above or below or above and below the reflective septum.

18. The apparatus of claim 10 wherein the fixture includes a translucent lateral shade and the reflective septum is configured to provide substantially uniform illumination of the shade.

* * * * *